United States Patent [19]

Doyle

[11] Patent Number: 4,471,594

[45] Date of Patent: Sep. 18, 1984

[54] WALL REPAIR KIT

[76] Inventor: Gaylord I. Doyle, 1065 W. Lomita Blvd., Harbor City, Calif. 90710

[21] Appl. No.: 436,263

[22] Filed: Oct. 25, 1982

[51] Int. Cl.[3] ..... E02D 27/00; B32B 35/00; E04G 21/00

[52] U.S. Cl. ..... 52/514; 156/98; 264/36; 52/743

[58] Field of Search ..... 52/514, 743, 744; 428/63; 156/94, 98; 264/36

[56] References Cited

U.S. PATENT DOCUMENTS

| | | | |
|---|---|---|---|
| 2,638,745 | 5/1953 | Wieman | 52/514 |
| 2,997,416 | 8/1961 | Van Wyke H. Helton | 156/98 |
| 3,325,955 | 6/1967 | Haut | 52/514 |
| 3,583,122 | 6/1971 | Biegajski | 52/514 |
| 3,690,084 | 9/1922 | Leblanc | 428/63 |
| 3,834,107 | 9/1974 | Standing | 52/514 |
| 3,936,988 | 2/1976 | Miceli | 52/514 |
| 4,025,809 | 2/1978 | Sirkin | 52/514 |
| 4,193,243 | 3/1980 | Tiner | 52/514 |
| 4,285,183 | 8/1981 | Condit | 52/514 |

*Primary Examiner*—John E. Murtagh
*Assistant Examiner*—Andrew Joseph Rudy
*Attorney, Agent, or Firm*—Mahoney & Schick

[57] ABSTRACT

A wall repair kit includes a supporting member for disposition in back of an opening in the wall to be repaired. A mounting member is engageable with the supporting member for locating the supporting member in juxtaposition to the opening and locating means on the supporting member maintains the supporting member in operative relationship with said opening during the installation of the supporting member into permanent relationship with the opening.

The present invention relates to a wall repair kit for utilization in repairing holes in walls, hollow door structures and the like. It also relates to the method of patching such holes by the utilization of the device.

5 Claims, 11 Drawing Figures

WALL REPAIR KIT

BACKGROUND OF THE INVENTION

It is well known to those skilled in the art that it is extremely difficult to repair holes in wall board structures, hollow doors and the like because of the difficulty of providing a support for the patching material such as patching plaster or the like.

Various types of devices have been suggested in the prior art including those shown in U.S. Pat. Nos. 3,834,107; 3,874,505; 3,939,988; 4,075,809; and 4,100,712.

All of the devices disclosed in the aforesaid patents are relatively complex and entail installation problems which prevent their effective utilization. Consequently, public of these devices has not occurred and the problem which these devices are intended to solve still remains a vexatious one.

OBJECTS AND ADVANTAGES OF THE INVENTION

It is, therefore, an object of my invention to provide a wall repair kit which is capable of being utilized to repair an opening in a wall structure and which consists of a minimal number of component parts that can be readily assembled prior to the utilization of the kit.

Also within the contemplation of the invention is the method of utilizing the kit in patching a wall or similar structure.

An object of the invention is the provision of a wall repair kit which consists of a supporting member which can be formed in a variety of configurations, for example, circular to repair generally circular openings and square or rectangular where the openings correspond to the respective configurations of the supporting member. Engageable with the supporting member is a longitudinally translatable mounting member which is capable of being moved relative to the supporting member so that its inner end will engage the wall opposite the wall being repaired and maintain the supporting member in underlying relationship with the edge of the opening. Also provided is locating means for positioning the supporting member in a predetermined relationship with the opening and for maintaining the supporting member against displacement during the advance of the mounting member.

An additional object of the invention is the provision of a kit of the aforementioned character in which the supporting member is provided with a threaded bore and mounting member is correspondingly threaded to permit it to be axially advanced with respect to the supporting member. An associate object of the invention is the provision of a second threaded bore in the mounting member which is engaged by correspondingly threaded locating means which can be grasped during the advance of the mounting member and which can then be longitudinally advanced to cause it to assume a flush position on the outer surfaces of the supporting member.

A further object of my invention is the provision of a repair kit of the aforementioned character wherein the supporting member is constituted by a patching plate and the mounting member is consititued by a threaded bolt, or the like, while the locating means is constituted by a threaded bolt or the like.

A corresponding object of the invention is a method of installation of the repair kit in operative relationship with the hole to be repaired which includes the steps of forming installation slots in the perimeter of the hole to be repaired and the location of the supporting member behind the hole to be repaired by inserting it through the previously formed slots. The additional steps of the method include the axially advancement of the mounting member while the supporting member is maintained in operative relationship with the perimeter of the opening to be repaired and the subsequent advance of the locating member into flush relationship with the outer surface of the supporting member.

BRIEF DESCRIPTION OF THE DRAWING

Other objects and advantages of the invention will be apparent from the following specifications and the accompanying drawings in which:

FIG. 10 shows the filling of the opening with patching plaster or the like.

DESCRIPTION OF PREFERRED EMBODIMENT

Figure 1:
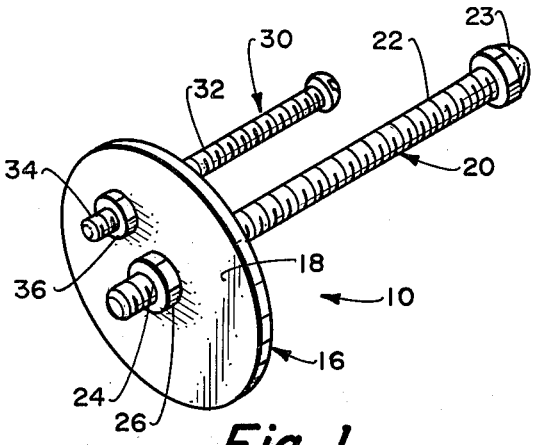
FIG. 1 is an isometric view showing one form of the repair kit in installed condition.

Referring to the drawings, and particularly to FIGS. 1–7 thereof, I show a repair kit 10 for utilization in patching an opening 12 in a wall board structure 14, or the like. The repair kit 10 can be utilized to repair openings in masonry structures, hollow core doors and similar applications where there are openings overlying an interior space which is defined by an adjacent interior wall opposite the wall being repaired.

The repair kit 10 is shown in assembled condition and includes a supporting member 16 constituted by a patching plate 18 of circular configuration. The supporting member 16 constituted by the patching plate 18 may be fabricated from any desired material but I have found that the plate can be effectively fabricated from such materials as synthetic plastics including the acrylic plastics. Of course, there is a wide range of materials that can be utilized for the supporting member 16. The circular configuration of the supporting member 16 is intended to conform to the roughly circular configuration of the opening 12 with which it is to be utilized.

Mounted in operative relationship with the supporting member 16 is a mounting member 20, said mounting member being constituted by a conventional threaded bolt stock 22 received in a correspondingly threaded bore 24 provided by a nut 26 which is glued or otherwise affixed to the inner surface of the supporting member 16. A lock nut 23 may be installed thereupon to assist in rotating said mounting member.

It will, of course, be obvious to those skilled in the art that various expedients for providing the threaded bore in the supporting member 16 can be utilized and it is not intended to limit the teachings of the invention to the specific showing of a nut in conjunction with the threaded bolt 22.

Also mounted in operative relationship with the supporting member 16 is locating means 30 constituding a handle 32 for maintaining the location of the supporting member 16 during the installation of the repair kit in operative relationship with the opening 12 in a manner to be described in greater detail herein below.

The locating means 30 is constituted by a threaded bolt 34 engageable with the correspondingly threaded nut 36 adhesively or otherwise secured in operative relationship with the inner surface of the supporting member 16.

It should be noted that, while the repair kit 10 is shown with the various components thereof in assembled relationship, it is intended that the various components be packaged unassembled to facilitate the distribution and marketing of a number of different sizes and shapes of kits 10 in the same package.

Figure 2:
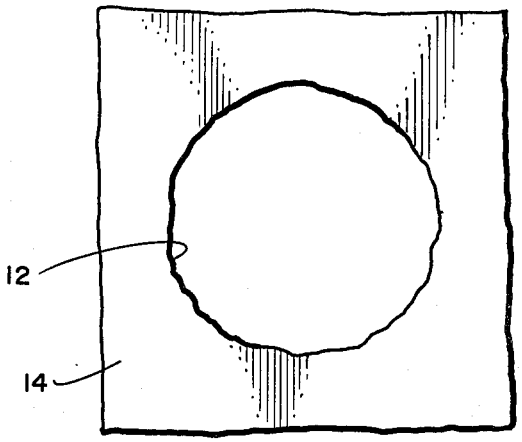
FIG. 2 is a front elevational view showing a typical hole or opening to be repaired.
Figure 3:
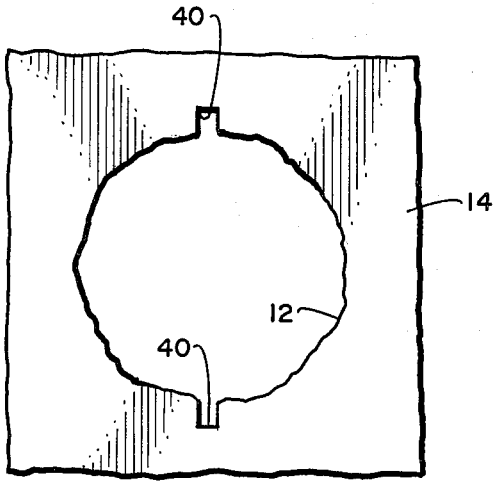
FIG. 3 is a front elevational view of the same hole or opening illustrating the formation of the preparatory slots therein.
Figure 4:
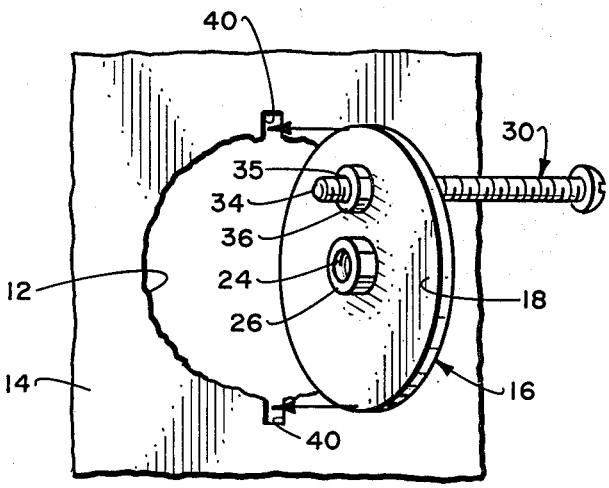
FIG. 4 illustrates the installation of the kit in operative relationship with the opening.

Illustrated in FIG. 2 of the drawings is the accidentally or otherwise formed opening 12 which it is intended the repair kit 10 will be utilized to repair.

In the practice of the method of the invention, oppositely disposed slots 40 are formed in the perimeter of the opening 12. The slots may be formed by the use of a suitable cutting tool such as a scroll saw or a knife.

After the formation of the slots, a supporting member 16 of a size slightly larger than the opening 12 is selected and the locating means 30 installed in the corresponding bore 35 of the nut 36. While holding the locating means 30 at top center which constitutes the handle for the supporting member 16, the supporting member 16 is fitted through the slots 40 and then rotated into a plaine corresponding to the exterior surface of the wall board 14 in which the opening 12 has been formed.

Figure 5:
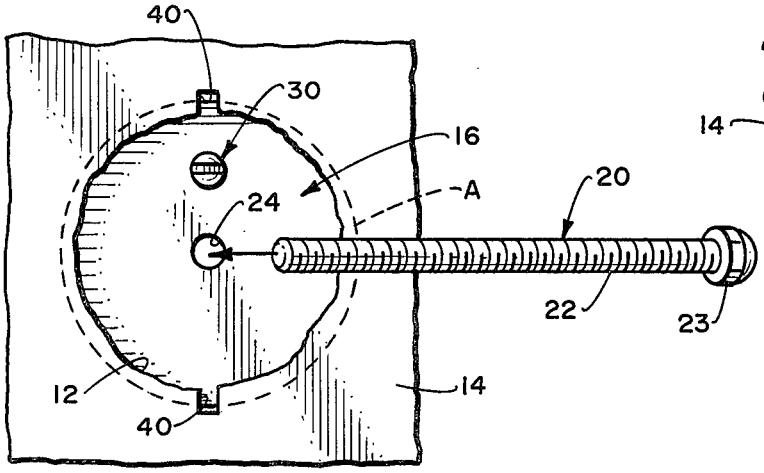
FIG. 5 illustrates the installation of the mounting member in operative relationship with the supporting member.
Figure 6:
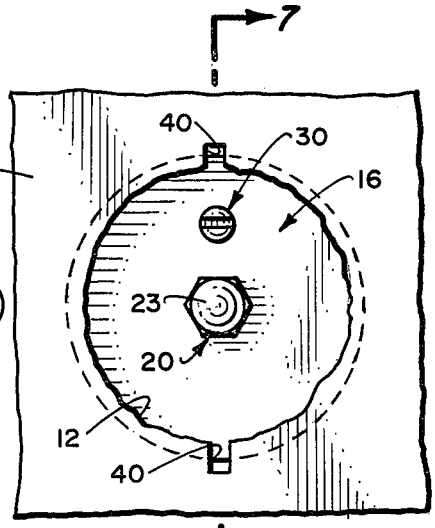
FIG. 6 shows the installed mounting member prior to the longitudinal and axial advance of the mounting member.
Figure 7:
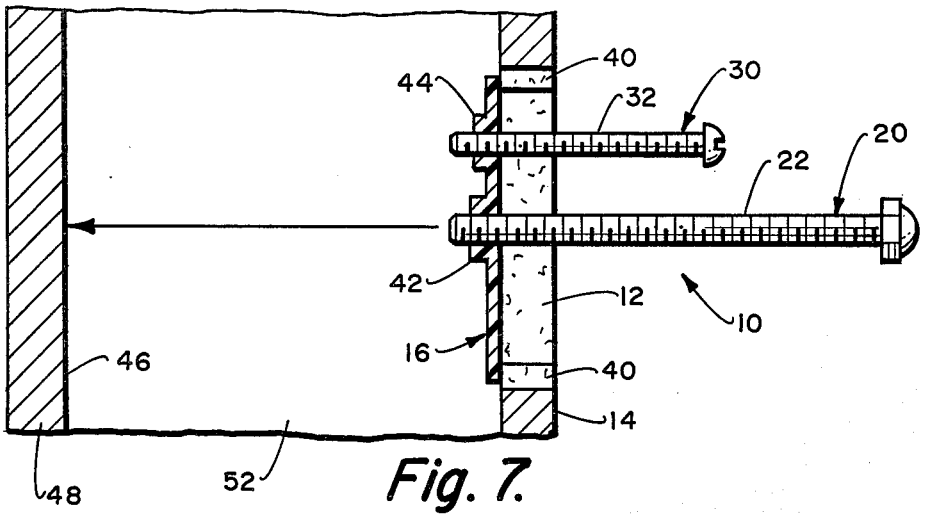
FIG. 7 is a vertical sectional view taken on the broken line -7- of FIG. 6.
Figure 8:
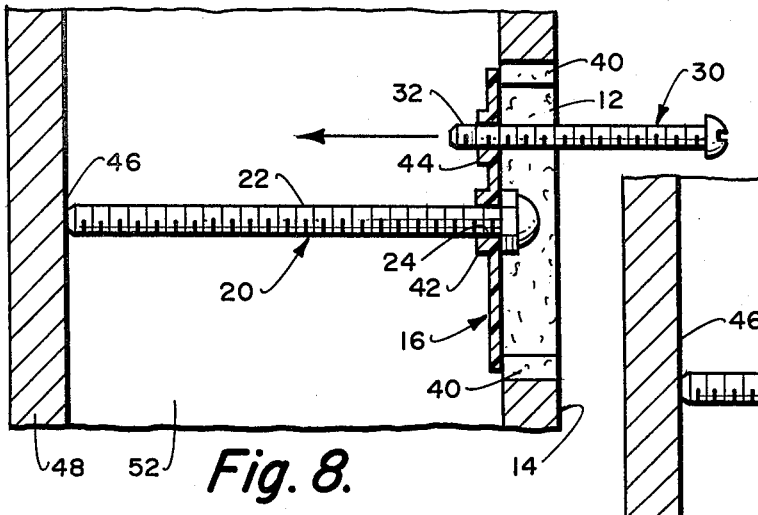
FIG. 8 shows the inner extremity of the mounting member impinging on the opposite surface of the adjacent wall structure to hold the supporting member in operative relationship with the perimeter of the opening to be repaired.

After the installation of the supporting member 16 in the opening 12 the mounting member 20 is threadedly engaged in the correspondingly threaded bore 24 as best shown in FIGS. 5, 6, and 7 of the drawings.

The overlap of the supporting member 16 with the perimetrical edge of the opening 12 is illustrated by the circular dash line A in FIG. 5 of the drawings.

In FIG. 7 of the drawings the initial condition of the kit 10 with all of the elements thereof properly installed is shown. Also shown in FIG. 7 is the formation of alternative bosses 42 and 44 on the supporting member 16 which are threaded for the reception, respectively, of the supporting member 20 and the locating means 30 constituting, respectively, the bolt 22 and the handle 32.

The bolt 22 is readily advanced through the corresponding threaded bore 24 until its inner end impinges on the inner surface of 46 of the other wall 48 defining the intervening space 52 therebetween.

Figure 9:
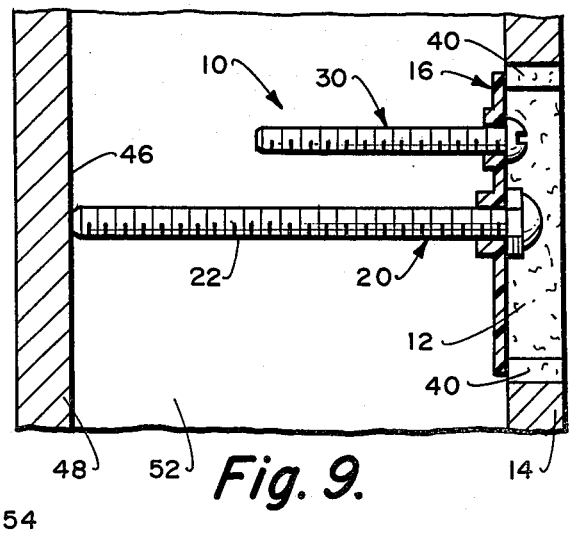
FIG. 9 shows the advance of the locating means into the space between the wall structures.

During the necessary roation of the bolt 22 the locating means 30 constituting the handle of the kit is grasped by the other hand of the user of the kit to maintain the supporting member 16 in operative relationship with the perimeter of the opening 12. Once the inner extremity of the bolt 22 impinges on the inner surface 46 of the other wall 48, the locating means 30 can be screwed inwardly, as best shown in FIG. 9 of the drawings, to locate both the heads of the supporting member 20 and the locating means 30 inwardly of the outer surface of the wall 14 incorporating the opening 12.

Figure 10:
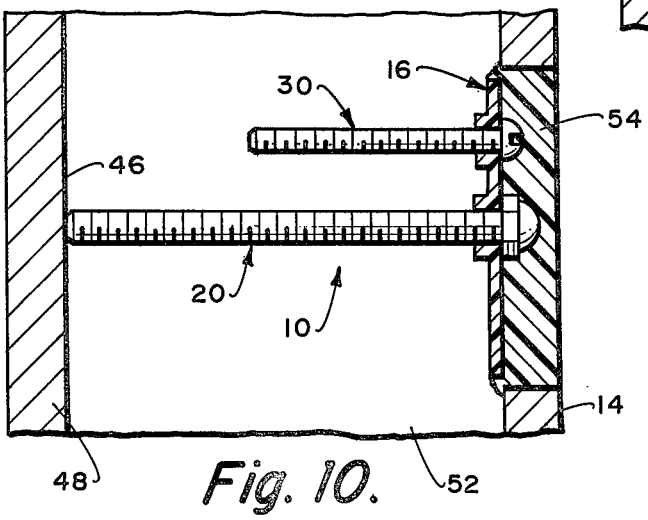

After the complete installation of the kit 10 in the above described manner, the patching material 54 can be applied and there is provided a completely flush patch which is adequately supported by the rigidly installed repair kit 10, as best shown in FIG. 10 of the drawing.

Another important aspect of the method of the invention is the fact that the slots 40 provide keys into which the patching material in installed thus providing an additional mode of affixing the patching material 54 in operative relationship with the wall board 14.

Figure 11:
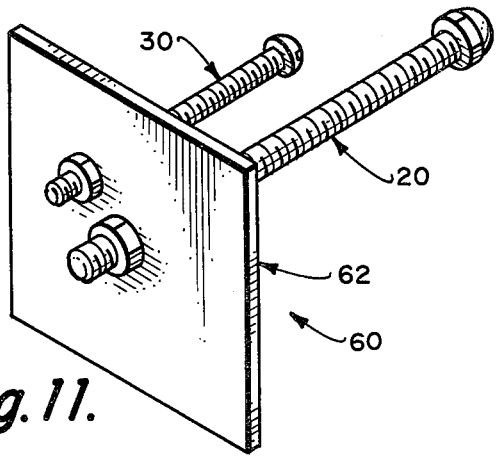
FIG. 11 is an isometric view of an alternative configuration of the repair kit utilizing a square supporting plate.

Illustrated in FIG. 11 of the drawings in an alternative repair kit 60 of the invention wherein the supporting member 62 is provided in square configuration rather than circular as in the previously discussed embodiment of the invention. Of course, it will be obvious to those skilled in the art that a wide variety of different shapes and sizes of supporting members could be provided to accommodate various applications of the repair kit 10.

Although I have described several embodiments of the invention, it will be obvious to those skilled in the art that alternations in the details thereof may be made without departing from the scope of the appended claims.

I claim:

1. In a repair kit for repairing an opening in a wall surface spanning a space defined by a second wall, the combination of: installation slot means formed in a perimetrical edge of said opening; a rigid patching plate insertable edgewise through said opening and slot means for flatwise alignment underlying said perimetrical edge of said opening; a bolt threadedly engaged in a correspondingly threaded bore in said patching plate and adapted to be advanced across said space into engagement with said second wall; and a rigid handle projecting forwardly from said patching plate which can be grasped to maintain said patching plate against rotation during the rotational advance of said bolt across said space, said handle then being removable from at least a major part of said forward projection.

2. The repair kit of claim 1 in which said handle is constituted by a rigid threaded member engaged in a correspondingly threaded bore in said patching plate spaced from said bolt threaded bore, said threaded member being advanceable in said bore with reference to said plate and into said space after the completion of the advance of said bolt to locate said patching plate in permanent relationship with the perimeter of said opening prior to the deposition of patching compound or the like on said patching plate.

3. In a method of patching an opening in a vertically oriented wall surface which defines a space in conjunction with another wall, the steps of: forming installation slots in the perimetrical edge of said opening; installing a rigid patching plate conforming to the general configuration of said opening through said opening and slots; mounting said rigid patching plate by inserting a mounting member therethrough and into supportive relationship with said other wall defining said space; during said mounting of said patching plate, retaining said patching plate in operative relationship with the perimetrical edge of said opening by a forwardly extending rigid handle connected to said patching plate; removing at least a major part of said handle from the forward extension thereof.

4. The method of claim 3 in which said rigid handle is threadedly engaged with said patching plate spaced from said mounting member and advanced into said space through said patching plate after the completion of the installation and location of said patching plate in juxtaposition to and underlying relationship with said opening.

5. The method of claim 3 in which a patching compound is deposited upon an outer exposed surface of said patching plate to repair said opening and said installation slots.

* * * * *